US010113293B2

(12) United States Patent
Briscoe et al.

(10) Patent No.: US 10,113,293 B2
(45) Date of Patent: Oct. 30, 2018

(54) BUCKET FOR CABLE SHOVEL

(71) Applicant: ESCO Corporation, Portland, OR (US)

(72) Inventors: Terry L. Briscoe, Portland, OR (US); Charles G. Ollinger, IV, Portland, OR (US); Joshua L. Strom, Tigard, OR (US)

(73) Assignee: ESCO Group LLC, Portland, OR (US)

( * ) Notice: Subject to any disclaimer, the term of this patent is extended or adjusted under 35 U.S.C. 154(b) by 855 days.

(21) Appl. No.: 14/013,973

(22) Filed: Aug. 29, 2013

(65) Prior Publication Data

US 2014/0165432 A1 Jun. 19, 2014

Related U.S. Application Data

(60) Provisional application No. 61/696,971, filed on Sep. 5, 2012.

(51) Int. Cl.
*E02F 3/407* (2006.01)
*E02F 3/60* (2006.01)
*E02F 3/30* (2006.01)

(52) U.S. Cl.
CPC ..... *E02F 3/4075* (2013.01); *E02F 3/308* (2013.01); *E02F 3/60* (2013.01)

(58) Field of Classification Search
CPC ... E02F 3/4075; E02F 3/60; E02F 3/40; E02F 3/30; E02F 3/308; E02F 3/407; E02F 3/342; E02F 3/3417; E02F 3/304
USPC ..... 37/398, 444; 414/722
See application file for complete search history.

(56) References Cited

U.S. PATENT DOCUMENTS

| | | | | | |
|---|---|---|---|---|---|
| 1,031,035 | A | | 7/1912 | Allen | |
| 1,215,089 | A | | 2/1917 | Wood | |
| 1,339,606 | A | | 5/1920 | Morton | |
| 1,642,189 | A | | 9/1927 | Bager et al. | |
| 1,653,620 | A | | 12/1927 | O'Fallon | |
| 1,712,040 | A | | 5/1929 | Houghtobt | |
| 1,780,351 | A | * | 11/1930 | Fykse | E02F 3/304 414/690 |
| 1,972,652 | A | | 9/1934 | Gill | |
| 2,018,628 | A | | 10/1935 | Bager | |
| RE19,979 | E | | 5/1936 | Bager | |
| 2,091,974 | A | | 9/1937 | Fykse | |
| 2,140,460 | A | * | 12/1938 | Stiehl | E02F 3/304 414/690 |

(Continued)

FOREIGN PATENT DOCUMENTS

| | | |
|---|---|---|
| GB | 184906 | 8/1922 |
| SU | 1709028 | 1/1992 |
| WO | WO2009/010930 | 1/2009 |

*Primary Examiner* — Jessica H Lutz
(74) *Attorney, Agent, or Firm* — John Anderton

(57) ABSTRACT

A bucket for use with a cable shovel includes a shell and a door collectively defining a cavity for gathering material to be excavated. The door is pivotally secured about a pivot axis on the shell so that the door can pivot between a closed position for gathering the material and an open position for dumping the material. The pivot axis is positioned forward of an exterior surface of a back wall of the shell to create a shallower and less forceful door swing during dumping. The door has a front portion that is bent towards a digging edge on the shell so that the door has greater strength, improves bucket loading, and moves a portion of the shell away from the highest wear area.

14 Claims, 14 Drawing Sheets

(56) References Cited

U.S. PATENT DOCUMENTS

| | | | | | |
|---|---|---|---|---|---|
| 2,335,352 | A | | 11/1943 | Murtaugh | |
| 2,336,729 | A | | 12/1943 | Harris et al. | |
| 2,434,902 | A | | 1/1948 | Burdick | |
| 2,584,416 | A | | 2/1952 | Boehringer | |
| 2,604,221 | A | | 7/1952 | Edwards et al. | |
| 2,735,559 | A | | 2/1956 | Burdick | |
| 2,788,907 | A | | 4/1957 | Larsen | |
| 2,840,253 | A | | 6/1958 | Thompson | |
| 2,861,704 | A | * | 11/1958 | Kluckhohn | E02F 3/4075 414/715 |
| 3,278,057 | A | | 10/1966 | Drollinger et al. | |
| 3,578,188 | A | | 5/1971 | Drieschner | |
| 3,767,070 | A | | 10/1973 | Arnold | |
| 3,869,054 | A | * | 3/1975 | Moreau | E02F 3/407 37/444 |
| 4,006,832 | A | | 2/1977 | Auxer et al. | |
| 4,063,373 | A | | 12/1977 | Greer et al. | |
| 4,282,664 | A | | 8/1981 | Thiele et al. | |
| 4,443,957 | A | | 4/1984 | Novotny | |
| 4,517,756 | A | | 5/1985 | Novotny et al. | |
| 4,928,410 | A | * | 5/1990 | Walters | E02F 3/404 172/254 |
| 4,939,855 | A | | 7/1990 | McCreary | |
| 5,251,389 | A | | 10/1993 | Bessey | |
| 5,613,308 | A | | 3/1997 | Little | |
| 5,815,958 | A | * | 10/1998 | Olds | E02F 3/4075 37/411 |
| 5,815,960 | A | | 10/1998 | Soczka | |
| 6,219,946 | B1 | | 4/2001 | Soczka | |
| 6,467,202 | B1 | | 10/2002 | Brown, Jr. | |
| 6,591,521 | B2 | | 7/2003 | Brown | |
| 7,096,610 | B1 | | 8/2006 | Gilmore | |
| 2007/0107269 | A1 | | 5/2007 | Hren et al. | |
| 2007/0214688 | A1 | | 9/2007 | Wallet | |
| 2013/0195594 | A1 | * | 8/2013 | Knuth | E02F 3/304 414/697 |
| 2014/0079519 | A1 | * | 3/2014 | Hobenshield | E02F 3/4075 414/694 |
| 2015/0020636 | A1 | * | 1/2015 | Dretzka | E02F 3/302 74/490.01 |

* cited by examiner

BUCKET FOR CABLE SHOVEL

RELATED APPLICATION

This application claims priority benefits to U.S. Provisional Patent Application No. 61/696,971 filed Sep. 5, 2012 and entitled "Bucket for Cable shovel," which is incorporated herein by reference in its entirety.

FIELD OF THE INVENTION

The present invention pertains to a bucket for a cable shovel machine, and in particular to the door for the bucket.

BACKGROUND OF THE INVENTION

As shown in FIG. 13, Cable shovels 1 (also known as dippers) are large excavating machines which have been used widely in mining operations for over 150 years. The buckets 3 for these machines may have a capacity as large as 82 cubic yards. The buckets 3 includes an open top 4 for gathering earthen material during digging, and a door 200 forming the bottom wall 5 for dumping the gathered load 325. In regard to cable shovels, the back wall 6 of the bucket 3 is the wall to which the stick 300 (i.e., the end of the boom 301) is attached. The front wall 7 is opposite the back wall 6 and is the wall associated with the lip 302. A pair of opposing sidewalls 8 are each located between the back wall 6 and the front wall 7, and also often supports the ends of the lip.

The doors can be very heavy and at times may weigh over 30,000 pounds. The door has at least one plate with an interior surface to contain the material being excavated. The door 200 is hinged to supports on the back wall so as to be closed during digging, and opened during dumping. A releasable latch is provided to hold the door 200 in the closed position. The size and weight of the door combined with the weight of the load within the cavity of the bucket causes the door to experience stress. Often the load within the bucket is not centered and causes the door to experience twisting, bending, and torsional loading. The load may become off center during loading or may become off center when the operator contacts the tracks of the cable shovel or the edges of the truck body when maneuvering the bucket. The stresses can cause the door to crack and become damaged. To strengthen the door and minimize the twisting, bending, and torsional loading experienced, the plate is generally reinforced with supports. The supports increase the door stiffness and help the door resist the off center loading. The supports, however, increase the weight of the bucket.

In use, the bucket with the door in the closed and latched position is driven into the ground to collect a load. Once filled, the bucket is lifted and the machine rotated to position the bucket over an empty truck body of a mining dump truck. The latch is released to dump the load into the truck body. The door is free swinging so that when the latch is released the potential energy of the weight of the door and the load within the bucket transitions into kinetic energy and causes the door to swing quickly and forcefully downward. The door, when released, can sometimes strike the truck body resulting in damage to the truck and/or the door. To compensate, the operator will often raise the bucket higher than necessary to avoid contact with the truck or will lower the bucket onto the truck floor or the material already in the truck before releasing the door for a more controlled opening of the door. This practice of lowering the bucket also requires an additional lifting of the bucket up out of the truck body with enough lift for the open door to clear the sides of the truck body. This extra lifting and/or lowering on every digging cycle slows the process and results in less production. A higher dumped load can also cause damage to the truck as the load dropped from a higher position impacts the truck body with more force. After the load is dumped, the operator swings the bucket away from the truck and lowers the bucket back to engage the ground. As the bucket is lowered to engage the ground the front wall approaches a horizontal position and the door approaches a vertical position, which causes the door to close under its own weight. The door will at times slam shut with great force and may cause damage to the bucket or the door. The latch, then, automatically actuates to secure the door for another digging pass.

The uncontrolled swing of the door can cause damage to mining equipment and can be dangerous to equipment operators and maintenance personnel. Many devices with varying degrees of success have been used to minimize the damage of the forceful swing of the door. For example, numerous snubbers, such as the snubber disclosed in U.S. Pat. No. 5,613,308, have been used to slow the uncontrolled swing of the door. In addition, hydraulic circuits as disclosed in U.S. Pat. No. 6,219,946, and brake and clutch devices as disclosed in U.S. Pat. No. 6,467,202 have been used to control the swing of the door. Bumpers have been used to protect the bucket as the door closes and to protect the tracks of the cable shovel if the door is opened to close to the cable shovel. The devices used to restrain and dissipate the kinetic energy of the load and the door are expensive, increase the weight of the bucket, and require intensive maintenance.

A typical latch includes several components that add considerable weight to the bucket. Each cable shovel is designed to lift a maximum weight, which is the combined weight of the bucket and the load of excavated material. Accordingly, the more weight that exists in the bucket, the smaller the load that can be gathered into the bucket or the less wear material that can be fitted to the bucket. Moreover, on account of the placement of the latch along the bottom of the door, it is common for these parts to need frequent repair or replacement because of the heavy loads and abrasive materials encountered. The latch system must be regularly adjusted to ensure that the latch fully engages the latch keeper as the latch experiences wear. Adjusting the latch bar because of wear can be very time consuming (i.e., increased downtime which translates into a decrease in productivity).

SUMMARY OF THE INVENTION

The present invention pertains to improvements in buckets for cable shovels that provide increased production, less wear and damage to the truck body and bucket, and greater safety.

In one aspect of the invention, the hinge axis for the door is located forward the exterior surface of the back wall of the bucket (i.e., the surface to which the stick is connected). This repositioning of the pivot axis results in the axis of rotation for the door being closer to the door's center of gravity which results in a smaller moment arm acting on the hinge pin and the lock or brake. The reduced moment arm allows for the door to be built with less bracing and structural robustness and may allow a smaller lock or restraint which could allow a lighter door to be utilized. This novel mounting arrangement results in a decrease in the potential energy, and creates a shallower and less forceful door swing during dumping. Because the door swing is less forceful, the door may not require snubbers or alternative devices to slow the swing of the door which further decreases the weight and potential energy of the door. A lighter door may allow the bucket to carry extra capacity or may be able to have more wear components added to the bucket. In addition bumpers may not need to be used to minimize the damage from the forceful swing of the door. As a result of the shallower and less forceful door swing, the operator can dump loads closer to the truck body for greater efficiency without the same risks of damaging the truck or other components on the cable shovel. The operator may not have to lower the bucket onto the truck floor or the material already in the truck before releasing the door which will reduce the likelihood that the operator will forget to lift the bucket sufficiently out of the truck body before swinging the bucket out of the way. The cable shovel will use less power and have less motor starting and stopping resulting in lower heat generation and wear. Removing the step of lifting the bucket out of the truck body may save 2-3 seconds from the cycle time. The reduced cycle time could increase productivity by as much as 5-10 percent.

In another aspect of the invention, the hinge members connecting the door to the shell are generally linear. A generally linear hinge member, when compared to the traditional hooked or gooseneck hinge member, reduces the stress concentrations within the hinge, reduces the amount of material in the hinge, and reduces the weight of the door.

In another aspect of the invention, improvements in the latch are provided by moving the latch location or replacing the latch with an alternative brake. In one embodiment, the door may be adequately secured in the closed position without a latch; i.e., by relying on a different kind of restraint such as a rod brake or a hydraulic circuit, which would impose less weight and/or fewer components. In another embodiment, the door may be secured in the closed position with a latch that is not in the high-stress, high abrasion bottom, front, central position where the typical latch is located. As an example, a latch may be provided on both sides of the door for less latch maintenance and a longer usable life for the latch. In another embodiment, the door may be adequately secured in the closed position with a smaller latch to impose less weight on the bucket and/or fewer components.

In another aspect of the invention, a door, a flap, and a restraint can be provided to selectively close the bottom of the bucket cavity. In some cases the door may interfere with the stick or the stick attachment supports. To overcome the potential interference, the rear of the door (i.e., the side closest to the hinge members) may be cut down to allow clearance. If the door is cut down a gap will be left in the back of the bucket (i.e., at the edge of the door closest to the back wall of the bucket) that would allow material to flow out of the bucket. A flap can be used to contain the material in the bucket and allow the material to flow out of the bucket when the door is opened. The flap can accommodate a shallower swing for a door with a hinge axis repositioned forward of the back wall when the door is retrofit in certain existing buckets or used with new buckets of the same existing design. The flap can also reduce the weight of the door on any bucket as the heavy door member covers only part of the bottom opening.

In another aspect of the invention, the door has a front portion (i.e., the portion closest to the front of the bucket and away from the hinges) that is slanted, bent, or curved inward toward the digging edge. This construction strengthens the door for greater durability and/or increased weight savings. The slant, bend, or curve creates a larger section modulus and moment of inertia to stiffen the door against bending. This construction also improves bucket loading by allowing material to move up the back of the bucket more easily. The curved door also moves the bottom end of the front wall of the bucket away from the highest wear area with only a little change in the bucket volume, which results in extended times between the need to refurbish the bucket.

DETAILED DESCRIPTION OF THE PREFERRED EMBODIMENTS

Figure 1:
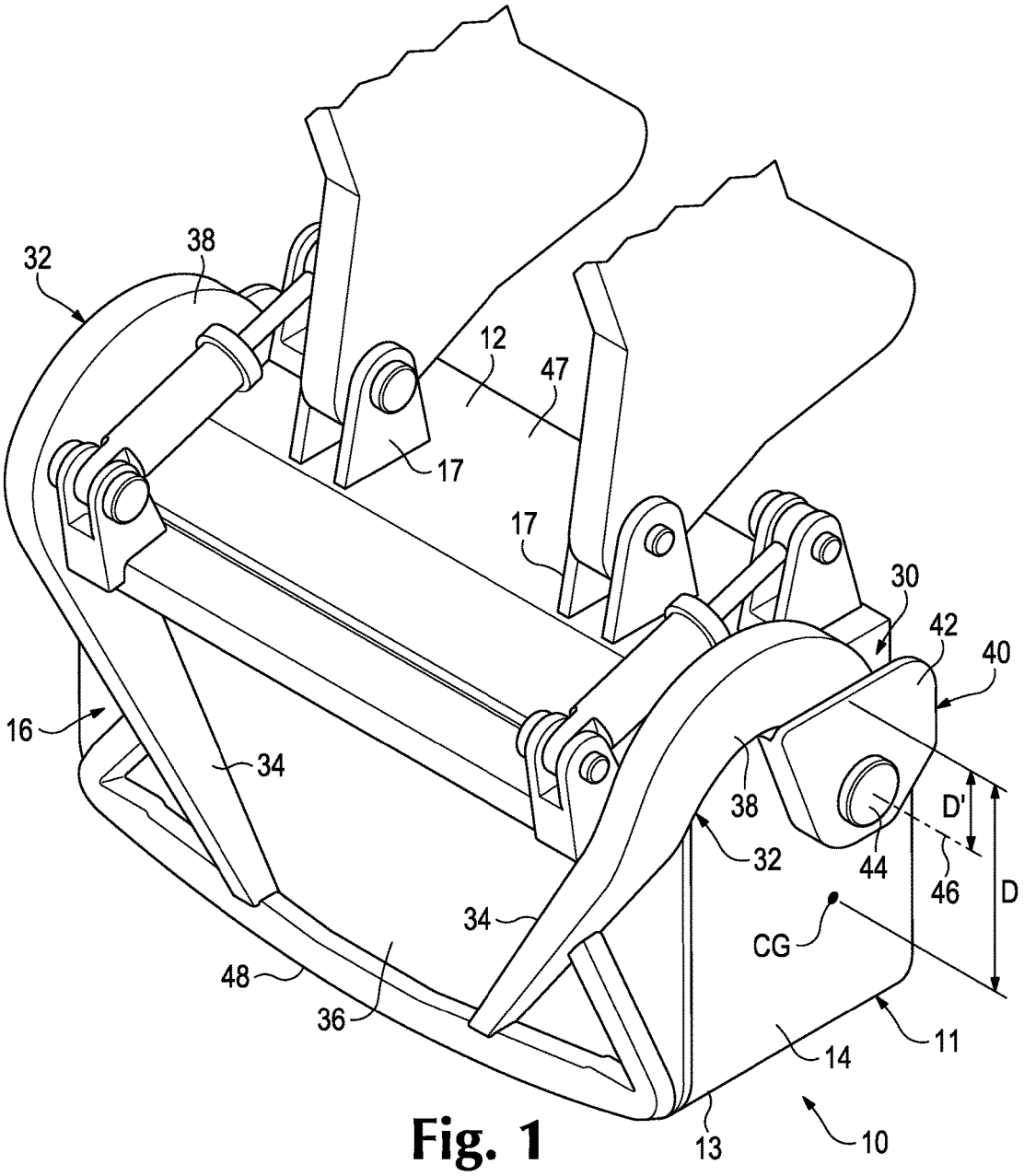
FIG. 1 is a perspective view of a bucket in accordance with the present invention without the hydraulic circuit shown in FIG. 2. Other details of the bucket including the lip, bail, and bail ear are omitted in this figure and other figures to simplify the drawings.
Figure 2:
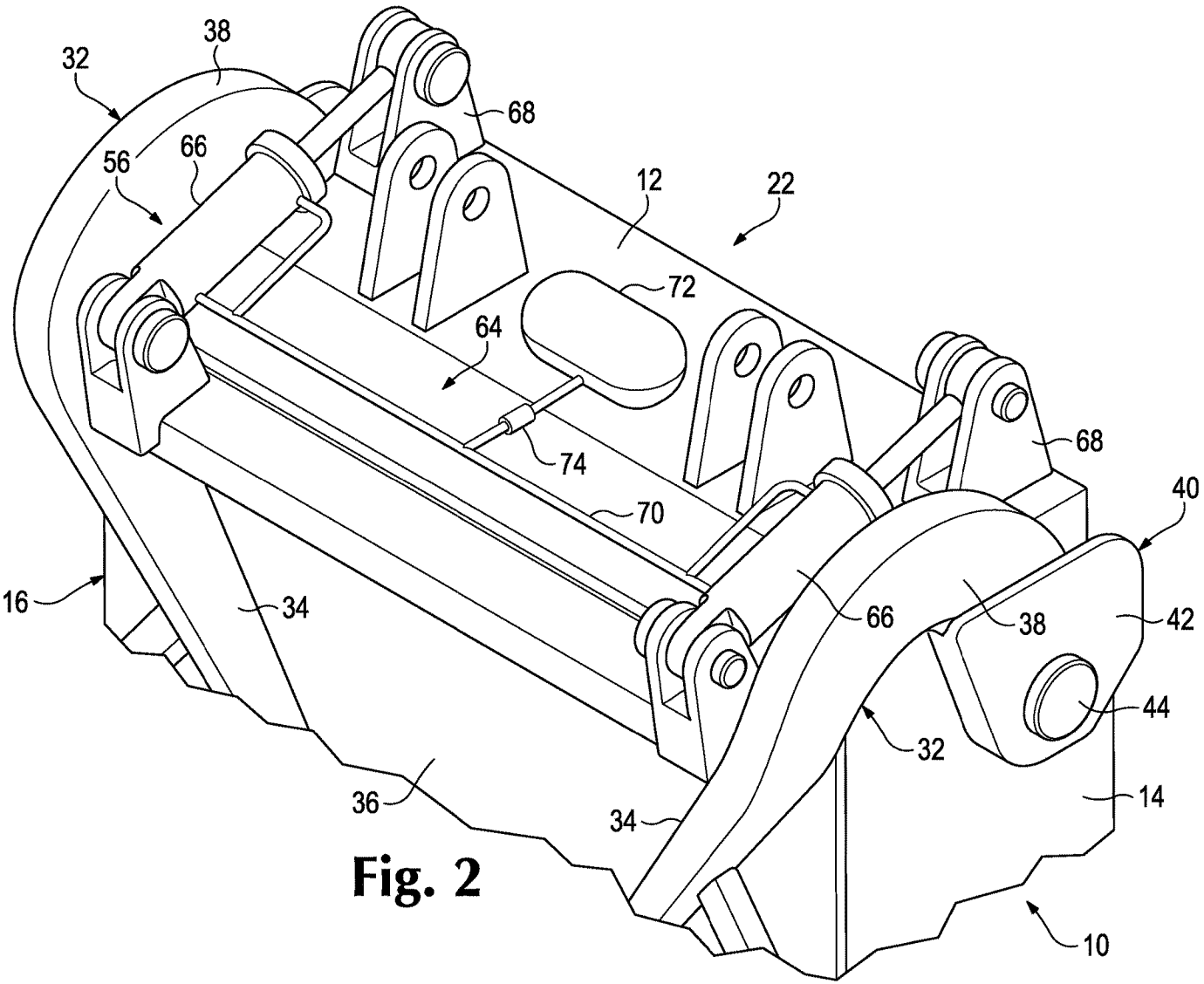
FIG. 2 is a perspective view of the bucket of FIG. 1 with the hydraulic circuit.

The present invention pertains to a bucket 10 for a cable shovel machine. A cable shovel bucket 10 includes a frame or shell 11. Shell 11 includes a rear end with a back wall 12 having attachment supports 17 to attach the bucket to earthmoving equipment, a front end with a front wall 13 opposite the back wall 12, and a pair of opposing sidewalls 14 each located between the back wall and the front wall. The shell may be constructed with walls having a single plate or may be constructed with portions of the bucket having double plates as is well known. If the shell is constructed with double plates, a top wall and a bottom wall 26 may be provided to connect the double plates. A door 16 with an interior surface and an exterior surface 36 is provided to define a bottom wall of the bucket (FIGS. 1 and 2). Door 16 has a front portion with a front edge adjacent the front end of the bucket, a rear portion with a rear edge adjacent the rear end of the bucket (i.e., the back wall), and opposite side edges extending between the front edge and the rear edge. This is the terminology that is used in this application. As can be appreciated, the back wall 12 will generally be the wall back away from the bank or material to be excavated during a digging operation. Similarly, the front of the bucket (i.e., the front wall) will be the portion that is the most forward with respect to the machine when the machine is moving in a forward motion and the bucket is in the dumping position.

Figure 7:
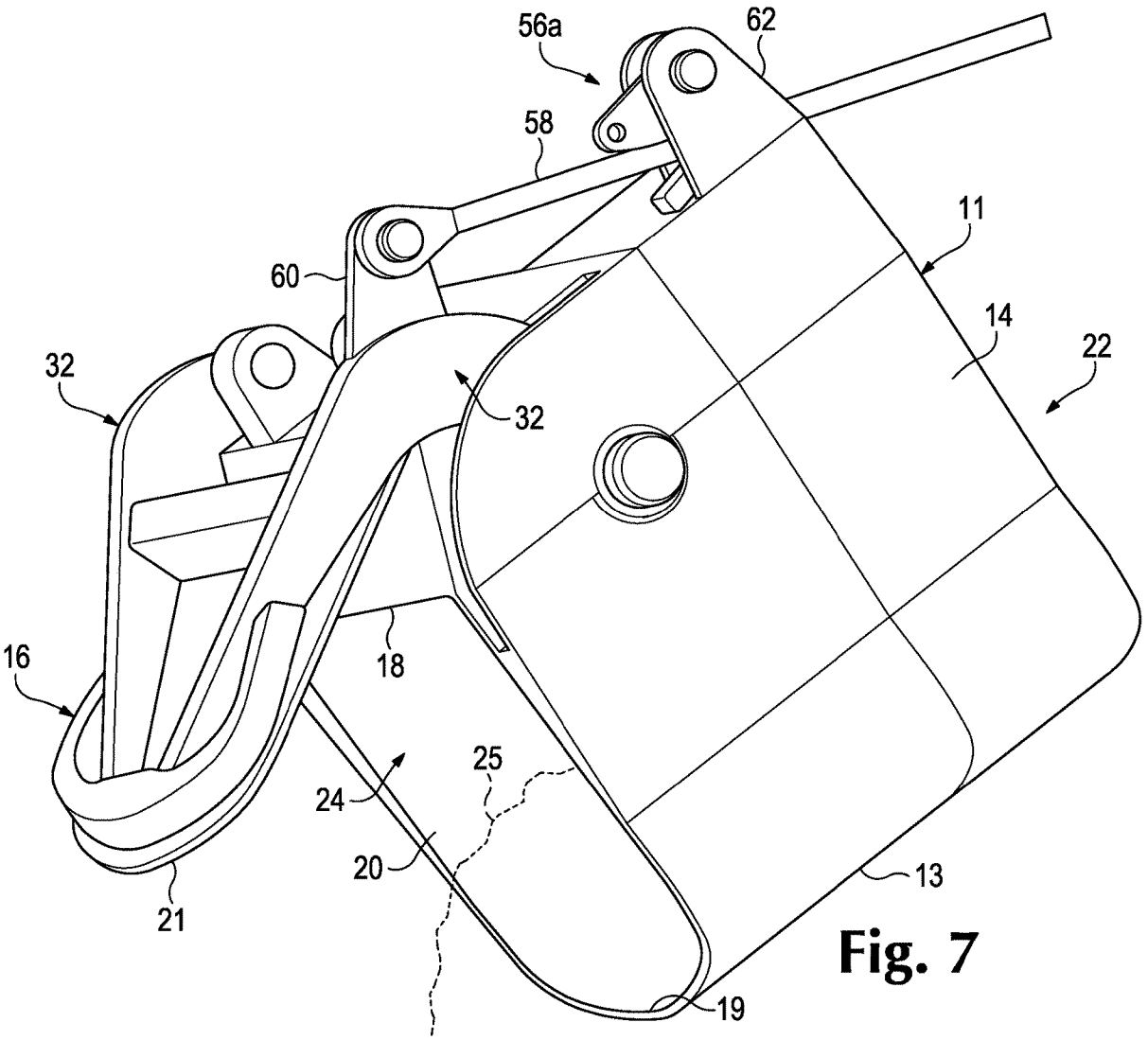
FIG. 7 is a perspective view of the third embodiment with the bucket in a dumping position.
Figure 13:
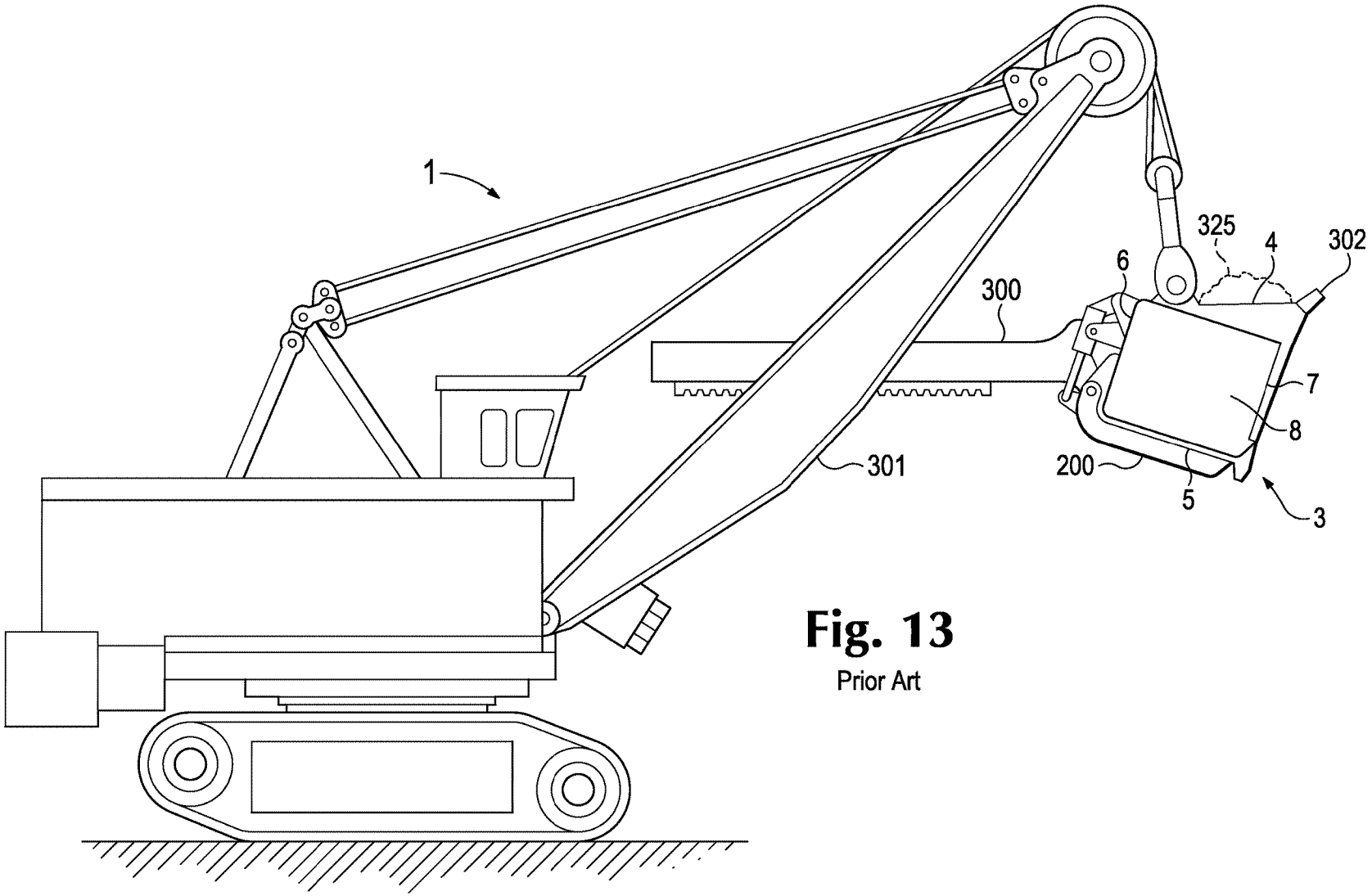
Fig. 13 Prior Art
FIG. 13 is a side view of a cable shovel and a conventional bucket and door in the dump position.

The shell walls 12-14 are interconnected to define a generally rectangular periphery. Each of the shell walls 12-14 includes an interior surface 18-20, i.e., back surface 18, front surface 19 and side surfaces 20. Door 16 includes a bottom interior surface 21. The interior surfaces 18-21 collectively define a cavity 24 into which the excavated material 25 is collected during digging (FIG. 7). Shell 11 has an open top 22 (which faces generally toward the material to be gathered in a digging operation) through which earthen material passes when it is gathered into cavity 24. A lip (not shown), similar to lip 302 shown in FIG. 13, may extend along an edge of the front wall 13, i.e., along the open end of the bucket, between sidewalls 14 to define the bucket digging edge. The lip is also often curved such that the ends of the lip extend partially up the sidewalls 14. Door 16 is pivotally secured to shell 11 by a hinge 30 that is preferably defined by a pair of hinge members 32 and pins 44 (FIG. 1). Each hinge member 32 is provided with a distal end provided with a pivot hole. Pins 44 create a pivot axis or hinge axis 46 about which door 16 pivots. Hinge members 32 are preferably mirror images with each other including a support portion 34 that is welded or otherwise secured to a portion of the outer exterior surface 36 of door 16, and a mount portion 38 that attaches to shell 11.

Figure 12:
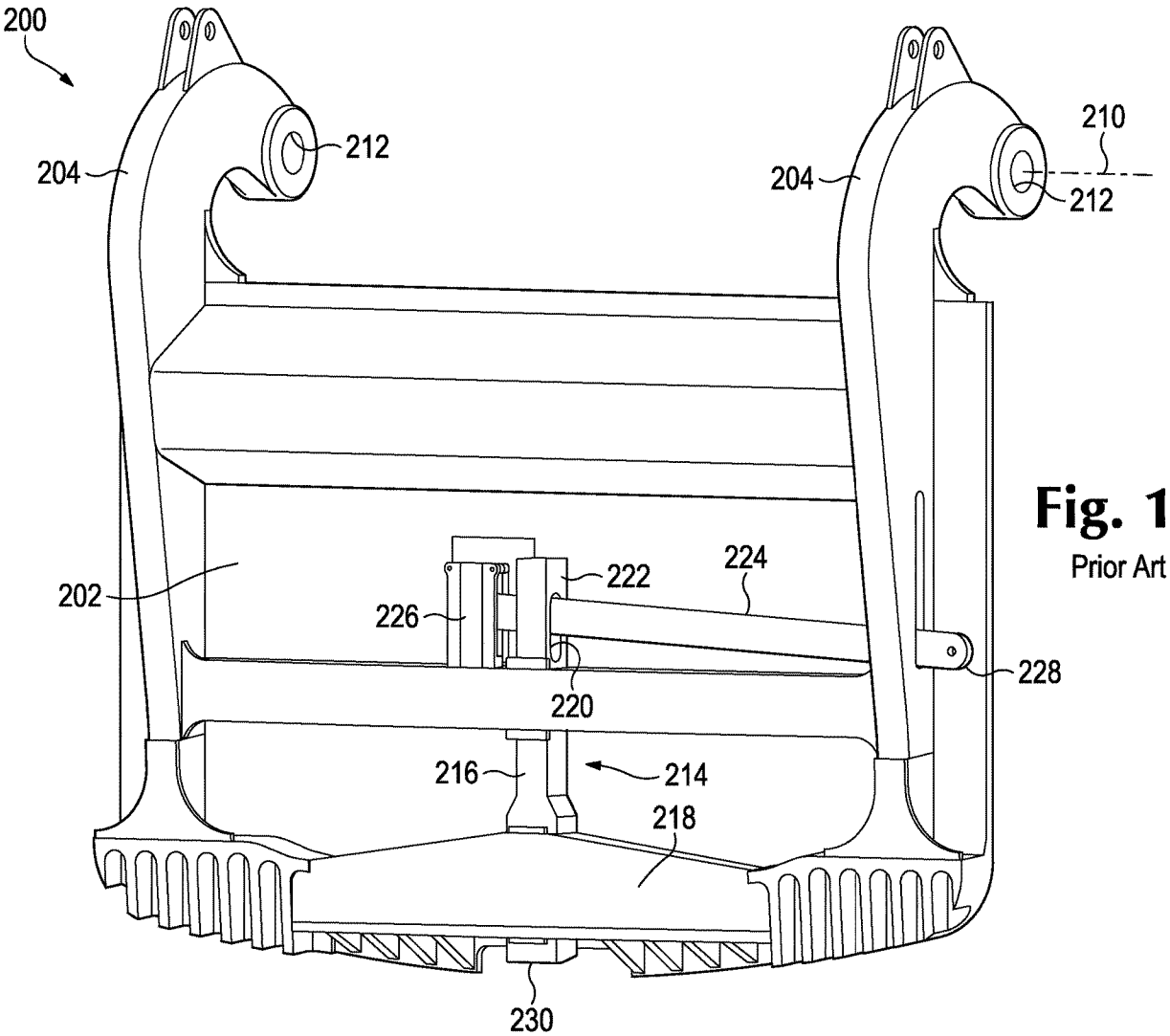
Fig. 12 Prior Art
FIG. 12 is a perspective view of a conventional door of a bucket for a cable shovel machine.

FIG. 12 shows one example of a conventional door 200 for a cable shovel bucket. Door 200 is generally defined by a primary plate member 202 that is sized and shaped to close the bottom of the bucket when the door is closed, and spaced hinge members 204 that are welded to the outer surface of the door. Hinge members 204 are pivotally secured to clevises welded to the back wall of the bucket. The pivot or hinge axis 210 for door 200 is rearward of the back wall of the bucket or, in other words, outside of the bucket cavity 24. In this example, a pin is fit into the holes 212 in hinge members 204 and devises to define the hinge axis 210 about which door 200 swings. This placement of the hinge axis 210 far from the center of gravity of the door causes the door to swing fast and forcefully during dumping of a load into a truck.

In the present invention, the pivot hole and the hinge axis 46 of bucket 10 is forward of the exterior surface 47 of back wall 12 (i.e., the exterior surface of the bucket that faces the cable shovel when the bucket is in the dumping position) and closer to the collective center of gravity CG for door 16 and the load in the bucket (FIGS. 1 and 2). The hinge axis 46 is positioned forwardly of exterior surface 47 of back wall 12, along distance D between back wall 12 and the center of gravity CG (FIG. 1) of a loaded door, to provide the desired swing of the door (i.e., with the desired force and shallowness of swing). It is preferably in a midrange between back wall 12 and the center of gravity CG, but it could be anywhere between exterior surface 47 of back wall 12 and the center of gravity CG that provided the desired swing of the door. The desired swing of the door may be optimized (i.e., the distance D' between the exterior surface 47 of back wall 12 and the hinge axis 46 may be varied) for various bucket geometries and for a number of different applications. For example, the size of the bucket, the shape of the bucket, the type of material being excavated, and the desired dump energy (i.e., the kinetic energy the material has as it is dumped from the bucket) may be considered when determining the hinge location (i.e., the distance D' between the hinge axis and the exterior surface of the back wall) to provide the optimal swing of the door. The hinge axis would have some spacing from the collective center of gravity for the door and the load to enable swinging of the door by gravity. This preferably places the hinge axis through a rear portion of cavity 24.

Figure 14:
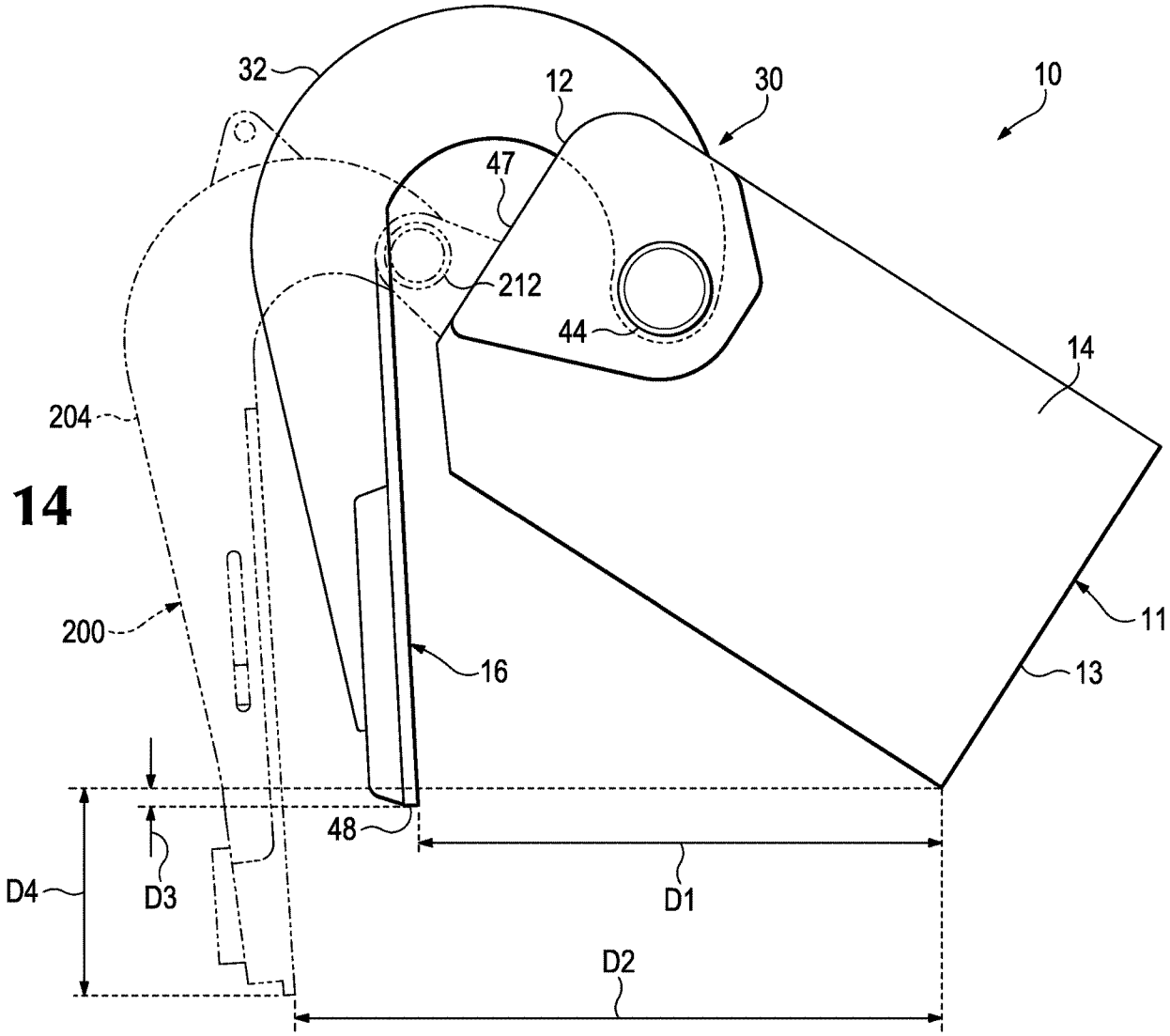
FIG. 14 is a side view of the first embodiment of the bucket in accordance with the present invention in the dumping position with the conventional door shown in FIG. 12 drawn in phantom lines.

The repositioning of hinge axis 46 forward of exterior surface 47 of back wall 12 will result in a shallower and less forceful swing for door 16 when the load is dumped. In a shallower swing, the bottom edge 48 of door 16 moves a shorter distance from shell 11 when the door moves from its closed position to its open position compared to a conventional door 200 secured rearward the exterior surface of the back wall of the bucket. This is illustrated in FIG. 14 which depicts a bucket 10 in the dumping position with door 16, in accordance with the present invention, with hinges 30 secured to pins 44 forward of exterior surface 47 of back wall 12 and a conventional door 200 with hinge members 204 secured to pins 212 rearward the exterior surface 47 of back wall 12. As illustrated, door 16 moves a distance D1 away from shell 11 that is less than the distance D2 door 200 moves when the doors move from their closed position to their open position. Also in a shallower swing, the bottom edge 48 of door 16 extends below the lowest portion of shell 11 a shorter distance in the open position when compared to the distance door 200 extends below the shell. As illustrated, door 16 extends below the lowest portion of shell 11 a distance D3 that is less than the distance D4 door 200 extends in the open position.

This shallower swinging of door 16 lessens the risk the door will strike the truck body during dumping without restricting the discharge of the load. The repositioned hinge axis 46 causes the door to move with less force and speed when opened so that if the door unintentionally strikes the truck body, there is less risk of damage to the truck body and the door. As a result, the shallower swing also enables the bucket to be positioned closer to the truck body for dumping, which results in greater productivity and reduced risk of damage to the truck body because of a shorter distance for the falling load (FIG. 14). The repositioning of the hinge axis forward of exterior surface 47 of back wall 12 obviates the need for the operator to lift the bucket higher to avoid any risk that the door will strike the truck body when released or to lower the bucket so the door sets on the truck body floor or already received material before releasing the door. Even if door 16 is set on the truck body floor or material already gathered in the truck body before it is released to dump the load, the benefit of a shallower swing enables the bucket to be swung away from the truck body with less bucket lift as compared to a conventional bucket. The provision of a door that swings shallower and less forcefully also improves worker safety and may eliminate the need for snubbers and bumpers.

In the illustrated example (FIGS. 1 and 2), support portion 34 of each hinge member 32 is an elongated body that extends diagonally across door 16 to give the door additional strength. Other strengthening arrangements could, of course, be used. Also, in this example, the mount portion 38 is defined by a hooked end with a hole that aligns with a pair of holes in clevis 40 or other suitable means secured to shell 11. Hinge members 32 are preferably bent so that the support portion 34 extends inwardly from hooked end 38 to extend across the exterior face of door 16, while the hooked end 38 extends perpendicular to hinge axis 46 outside of sidewalls 14. In the illustrated embodiment, each clevis 40 is formed by a plate 42 fixed in a spaced relationship to the respective sidewall 14. This can be incorporated into the structure of the bucket as a box section design is common in this section of the bucket construction. Other hinge constructions could be used. A pin 44 is fit through the holes in the clevis 40 and the respective hinge member 32 to form a pivot connection about which door 16 moves. The pins 44, therefore, define the axis of rotation or hinge axis 46 for door 16 to move between the open and closed positions.

Figure 3:
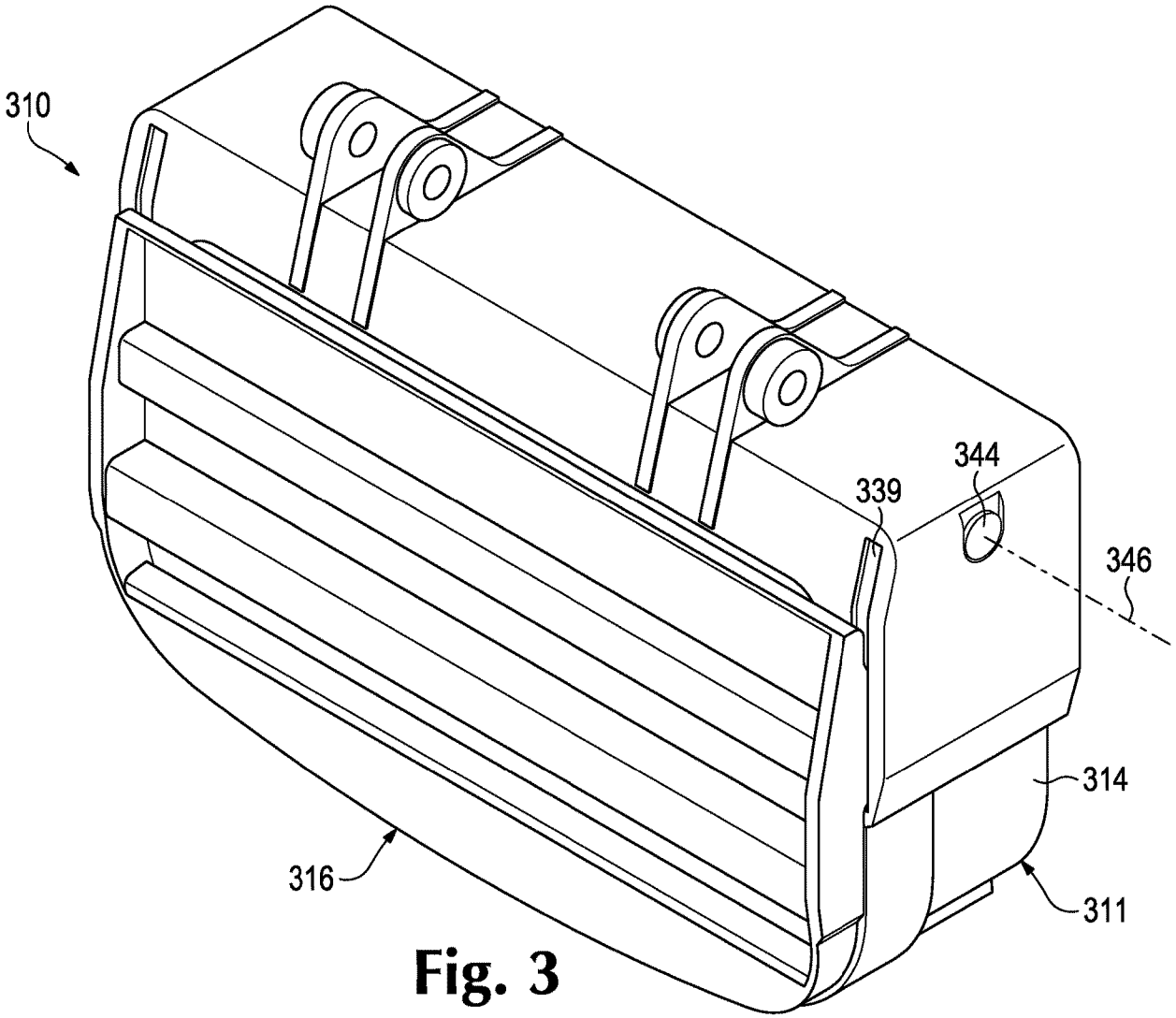
FIG. 3 is a perspective view of a second embodiment of a bucket in accordance with the present invention with the restraint omitted
Figure 4A:
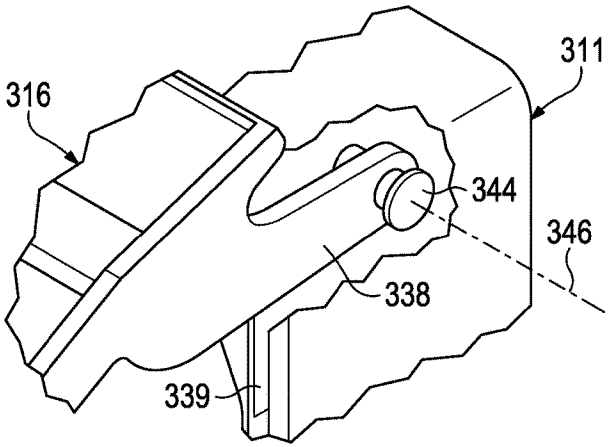
FIG. 4*a* is breakaway view of showing the hinge in FIG. 4.
Figure 4:
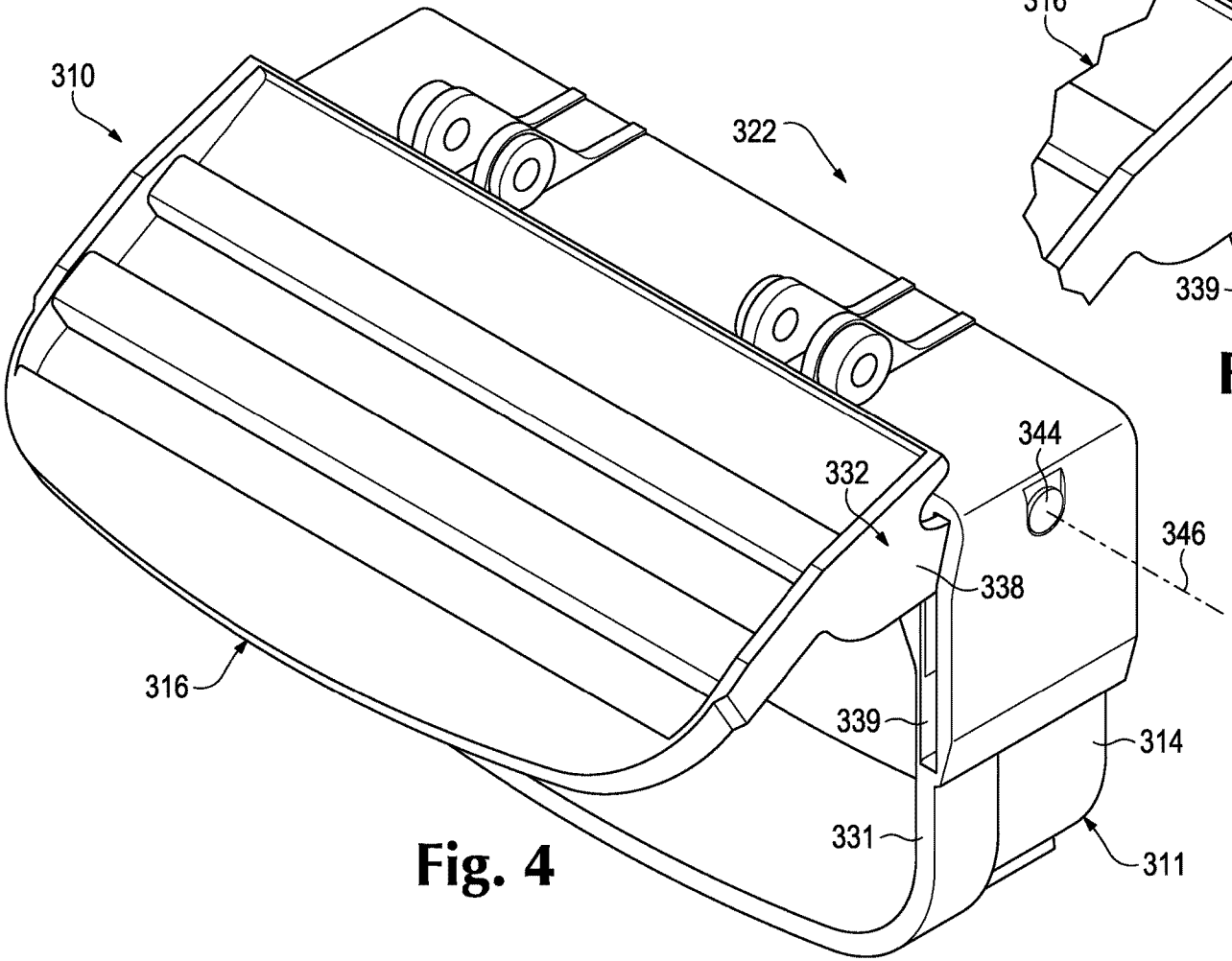
FIG. 4 is a perspective view of the second embodiment with the bucket in a dumping position with the restraint omitted.

In an alternative embodiment (FIGS. 3, 4, and 4*a*), bucket 310 includes a shell 311 and door 316 that is similar in many ways to shell 11 and door 16 with many of the same benefits and purposes. The following discussion focuses on the differences and does not repeat all the similarities that apply to bucket 310. Each Sidewall 314 contains a slot 339 along an edge 331 facing the door 316 (i.e., the edge opposite the open top 322). The hinges 332 are defined by a generally linear hinge member 338 each provided with a hole that aligns with a hole within the respective sidewall 314. Hinge members 338 preferably first contact door 316 at a location below the rear edge of the door 316 so that the hinge to door connection point is closer to the center of pressure of the load acting on the door. A connection point that is closer to the center of pressure reduces the moment force that acts on the door and creates a more stable door. Hinge members 338 are inserted in slots 339 to attach door 316 to shell 311. Other hinge constructions could be used like the clevis in bucket 10. A pin 344 is fit through the hole in the sidewall and the respective hinge member 338 to form a pivot connection about which door 316 moves. The pins 344 define the axis of rotation or hinge axis 346 for door 316 to move between the open and closed positions. During the digging operation the door generally protects the slots and minimizes the fines that can enter the openings. When the door is released to dump the material being excavated, the amount of fines that can enter the slots are minimized by gravity since the slots face downward. Use of linear hinge members, instead of ones that are hooked and bent as in bucket 10, reduces the amount of stress experienced in the hinge. A linear hinge member also reduces the amount of material needed to connect the door to the shell and thus reduces the weight of the bucket.

Conventional door 200 (FIG. 12) includes a latch 214 that advances to hold the door in the closed position, and retracts to release the door during dumping. Latch 214 includes a latch bar 216, which is secured in a vertical position along the center line of door 200 by a guide structure 218. Latch bar 216 includes a slot 220 near its top end 222 to receive a lever 224 extending transversely through the slot. Lever 224 is constrained within a pivot box 226 to one side of latch bar 216 for pivotal movement. An actuator (not shown) is secured to the free end 228 of lever 224 to move the lever back when the door is to be opened. Forward and rearward movement of lever 224 results in forward and rearward movement of latch bar 216 (i.e., gravity moves the latch bar 216 down when the lever is moved forward). In the forward position, the end 230 adjacent front wall 13 of latch bar 216 is received into a latch channel secured to the bucket shell to secure the door in the closed position. This forward position is referred to as the latched position. In the opposite, unlatched position, the bottom end 230 of latch bar 216 is withdrawn from the latch channel to release the door during clumping. The unlatched position (i.e., where the latch bar 216 moves toward the bucket back wall 12) is referred to as the release position.

A conventional latch 214 can be used in connection with door 16 or door 316. Nevertheless, a conventional latch 214 has disadvantages. For example, latch bar 216 and the latch channel are positioned along the front edge 230 of the door to provide sufficient resistance to the high forces that are the result of receiving a heavy load in the bucket. The center portion of the door near the front wall 13, however, is a high wear and high maintenance area on account of the abrasive material that passes by the components each time a load is dumped. Earthen material is prone to lodging in the latch channel and guide structure 218, requiring stoppage of the digging to clean out the material and free the operation of the latch bar. Further, latch 214 is a substantial assembly with a number of components. The latch bar 216 and other components are large, robust members to provide sufficient resistance to the heavy loads resulting from maintaining the door in a closed position with material contained within the dipper body, and from material striking the door during the digging portion of the operation. The heavy weight of the latch components adds considerable weight to the bucket, and reduces the load that can be gathered in the bucket during digging or the amount of wear material that can be fitted on the bucket. Reduced weight in the bucket and greater material loads may lead to higher production if the trucks are otherwise under filled; i.e., it is desirable for the buckets to fill the truck bodies in one or more full dumps of the bucket. Reduced weight in the bucket may also enable the addition of increased wear material for a longer usable life.

Since the forward repositioning of hinge axis 46 requires less resistive force to keep the door closed, a conventional latch 214 may not be needed, though the inventive door could include a conventional latch. Alternatively, a brake 56 can be used in lieu of a latch to prevent unintended opening of the door. In one example (FIG. 2), a hydraulic circuit 64 can be used in lieu of latch 214. In this example, circuit 64 includes a pair of hydraulic cylinders 66. Each cylinder 66 is coupled between door 16 and a clevis 68 secured to back wall 12. Fluid lines 70 connect cylinders 66 to an accumulator 72. The cylinders work as a unit to snub and lock the door in the closed position. The circuit utilizes the accumulator 72 to store energy for the residual pressure in the cylinders. Opening valve 74 allows pressure to flow from the cylinders 66 to the accumulator to open a loaded door, and back into the cylinders to close the door after dumping. Circuit 64 is a low cost, light weight alternative to latch 214. The use of circuit 64 will reliably provide uniform pressure to both hinge members 32.

Figure 5:
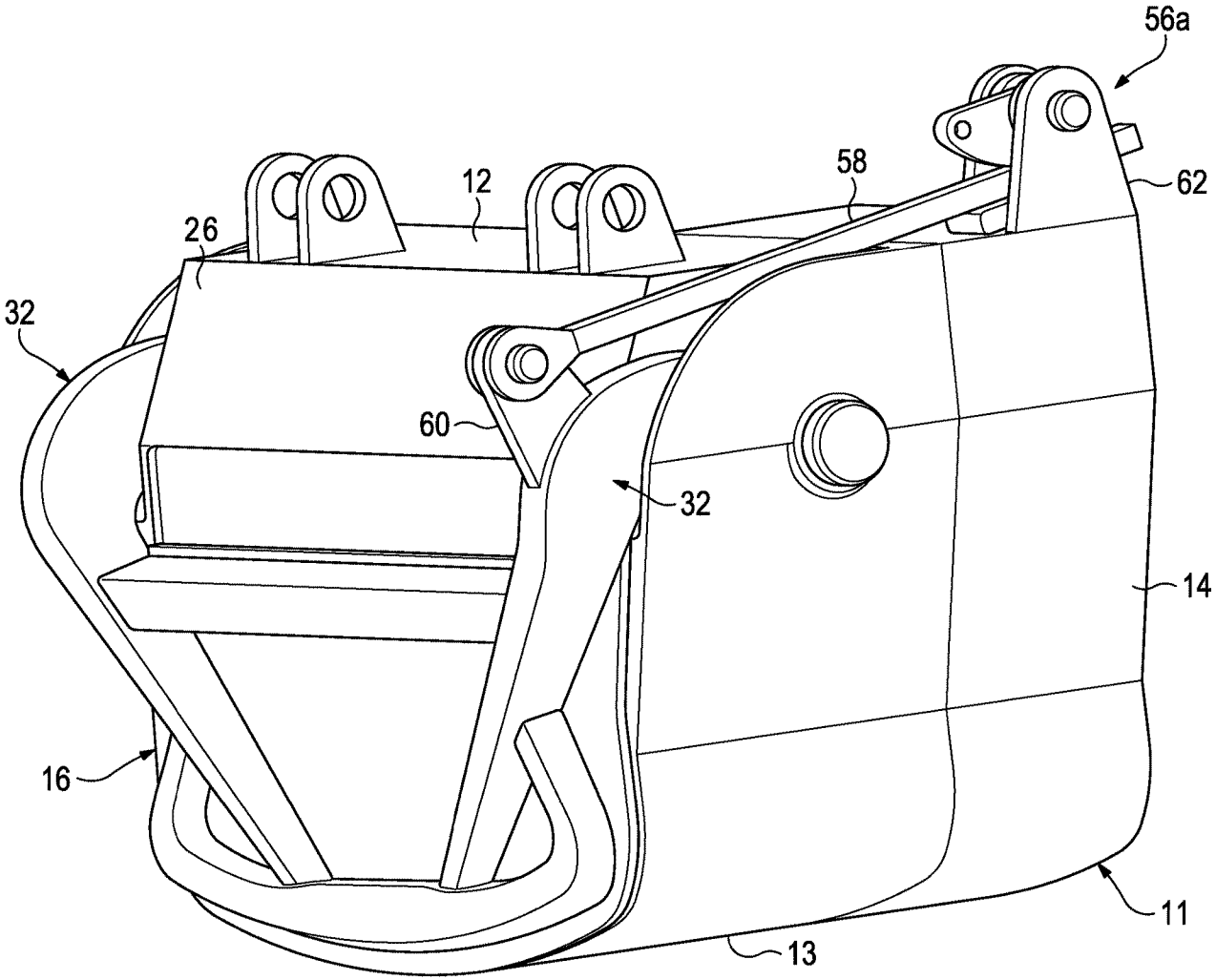
FIG. 5 is a perspective view of a third embodiment of a bucket in accordance with the present invention.
Figure 6:
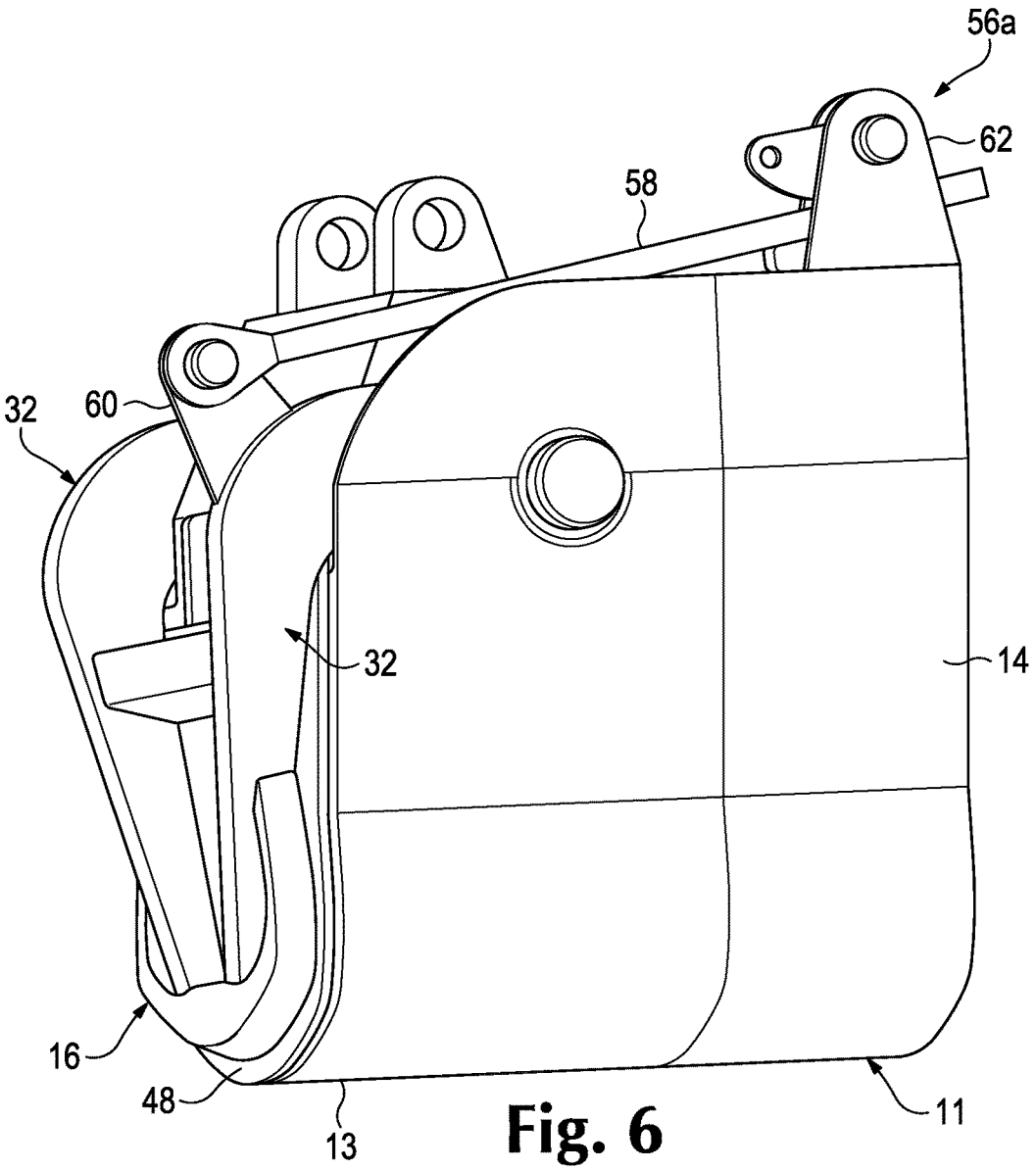
FIG. 6 is a perspective view (nearly a side view) of the third embodiment of the bucket.

In another alternative (FIGS. 5-7), brake 56*a* includes a rod 58 that is secured to a hinge member 32 via stem 60. Many types of brakes are known, in one example the rod 58 may pass through a cam type brake assembly 62 secured to back wall 12 of the bucket shell 11. Brake assembly 62 can be deactivated to permit free movement of door 16 to its open or closed position, or activated to securely grab rod 58 and prevent movement of the rod and door. A single brake 56*a* mounted in the center of the door can be used, or a brake 56*a* could be provided for each hinge member 32.

The elimination of latch 214 results in a reduction in the bucket weight, which leads to greater loads or the ability to secure more wear material to the bucket. The elimination of latch 214 also reduces the high maintenance and repair needs associated with the latch, and results in a means for holding the door closed (e.g., brake 56 or 56*a*) with a longer usable life. Further, the brake can be used to function as both a snubber and a lock. Using the brake for both purposes permits the elimination of a separate snubber, which is typically provided. A snubber is normally an apparatus that dampens the swing of the door by friction on rotating disks. Elimination of a separate snubber leads to less cost, weight and maintenance.

Figure 8:
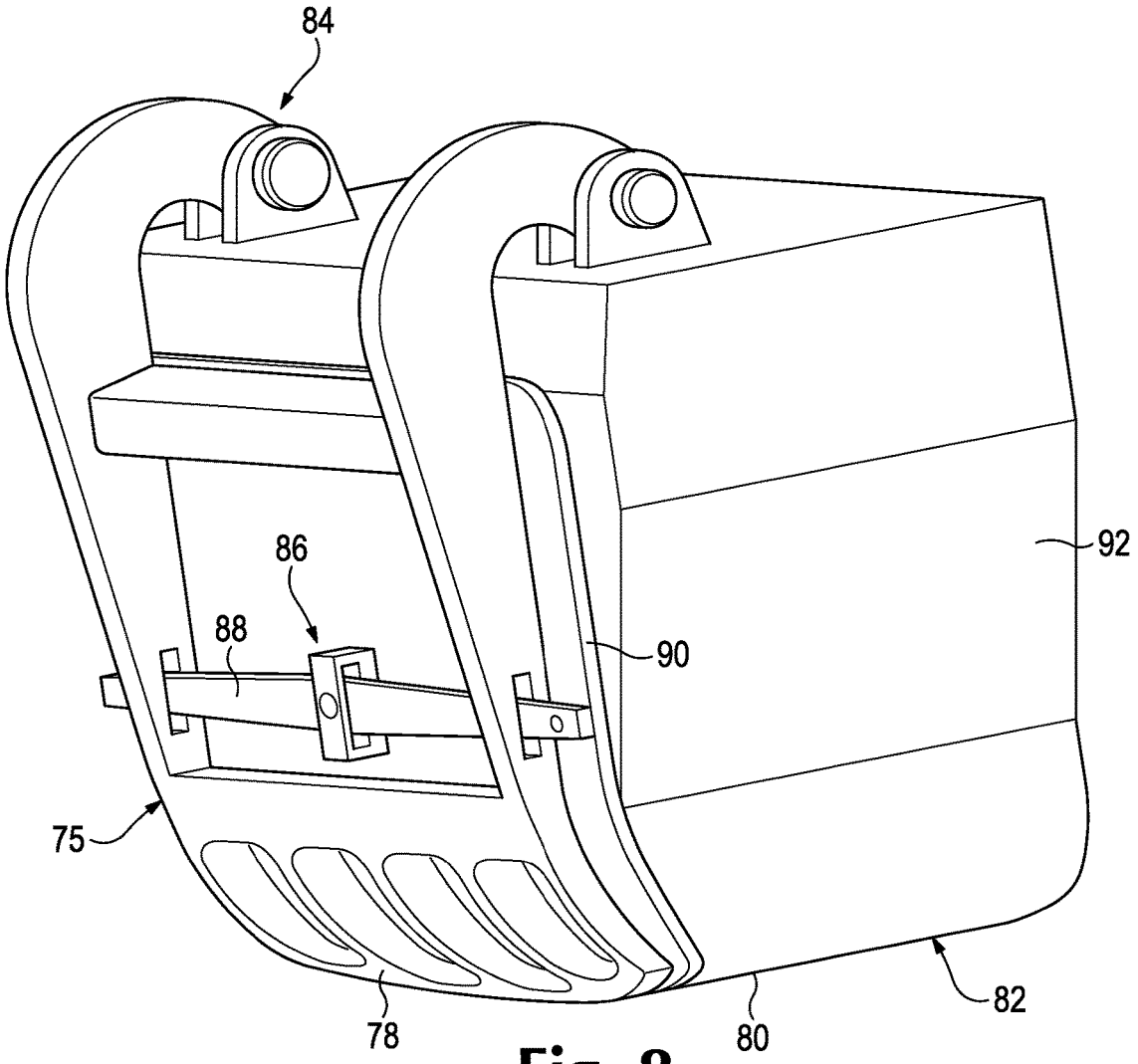
FIG. 8 is a perspective view of a fourth embodiment of a bucket in accordance with the present invention.
Figure 9:
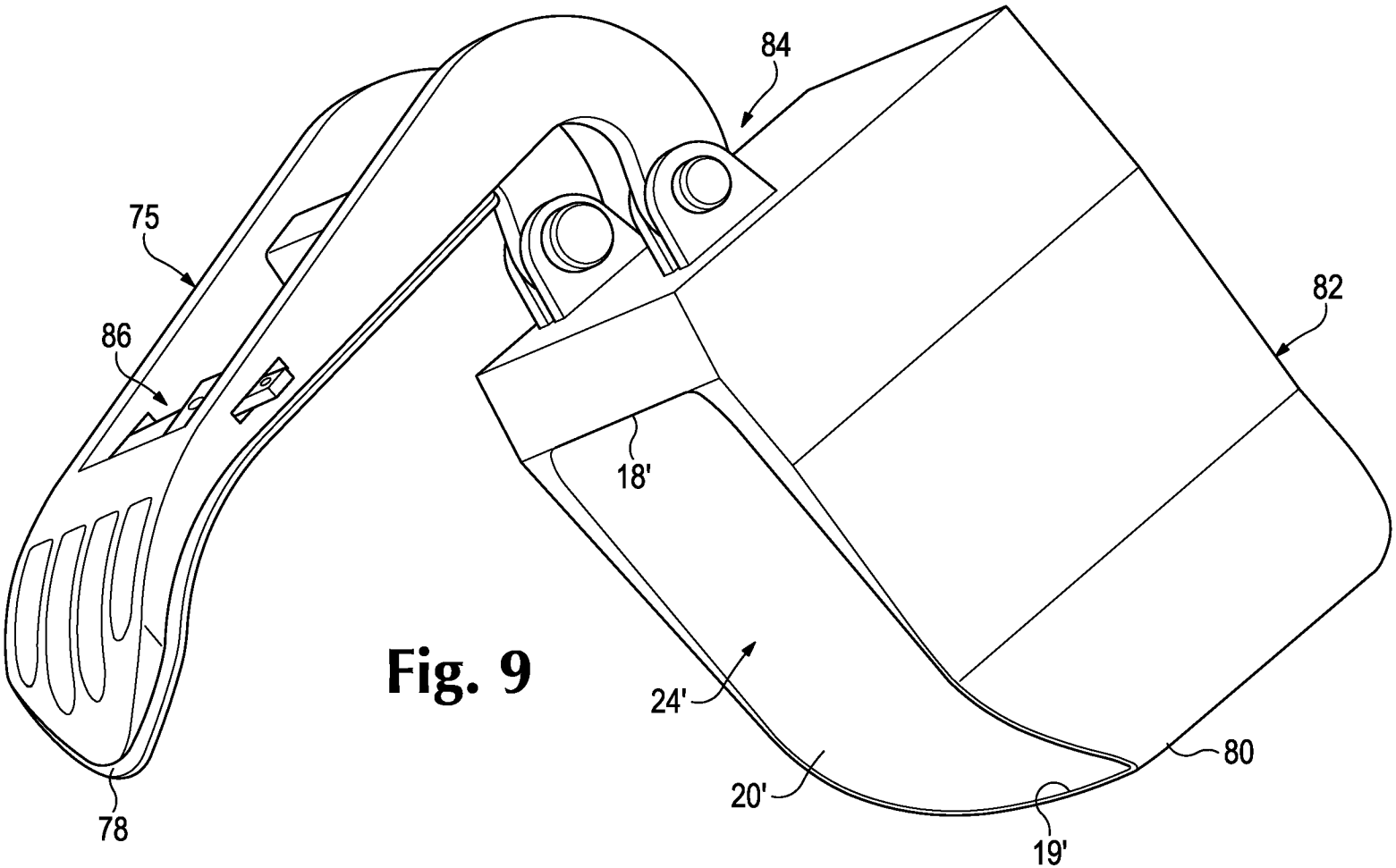
FIG. 9 is a perspective view of the fourth embodiment of the bucket in a dumping position.

In an alternative construction (FIGS. 8 and 9), a door 75 can be provided with a front portion 78 that is bent inward toward the digging edge. The term "bent" is intended to include a portion that is angled inward with a generally linear slant or is curved inward. The shell has complementary surfaces so that front portion 78 of door 75 abuts bottom edges of the shell when the door is closed. The formation of door 75 with a curvature, as opposed to a planar door, provides the door with greater strength. The increased strength of the curved door 75 enables the use of thinner steel plate or reduced supports for improved weight savings and/or provides a door which is more durable and/or provided with more wear material. The curved door 75 also increases the opening for improved material discharge, i.e., from cavity 24' defined by top surface 18', bottom surface 19' and side surfaces 20' (see FIG. 9). The curved door also permits the bucket to be lower over the truck body for dumping. The use of a curved door further repositions the heel 80 of the bucket shell 82 out of the high wear area at the lower, front corner of the bucket cavity; i.e., the bucket shell 82 curves forwardly at the heel 80 such that door 75 forms the front, lower corner of cavity 24'. This is an advantage as the door is easier and cheaper to repair or replace than the shell of the bucket. Door 75 can be used with a conventional hinge 84 (i.e., with a hinge axis rearward of the back wall of the bucket shell) as shown in FIGS. 8 and 9, or with hinge 30 or 332 for the benefits provided by having a hinge axis 46 forward of back wall 12. Brake 56 or **56*a* could be used to secure the curved door 75** in the closed position.

In the illustrated alternative, a latch 86 is provided with at least one lateral latch bar 88 that moves so that each end, laterally beyond the sides 90 of door 75, is received in latch channels (not shown) secured to the sidewalk 92 of shell 82. The latch bar 88 can be moved by a rotary mechanism (not shown). Numerous types of rotary mechanisms and methods for operating the rotary mechanisms are widely known. For example, the rotary mechanism could move two latch bars 88 hooked (not shown) to the same driver, one on top of the driver the other on the bottom of the driver, so that the free ends of each latch bar 88 moves laterally outward or inward to latch or unlatch the door. In an alternative example, one latch bar 88 could pivot in the middle of the door with one latch bar end going down on one side and the latch bar end going up on the other side. In this example one latch channel would have an opening that faced towards the front end of the bucket to accept the latch bar moving upwards and one latch channel would have an opening that faced towards the rear end of the bucket to accept the downwardly moving latch bar. Using one latch bar 88 ensures that both ends of the latch bar move the same distance and minimizes the likelihood that one of the latch bars would become hung up and not allow the door to fully latch.

Latch 86 may have a spring mechanism so that when the door closes the bar is deflected in a rotational manner against the biasing action of the spring, and then springs back to engage the latch channels and held in place by the biasing spring. The latch could be unlatched by a trip cable that overcomes the spring bias. In an alternative, the latch bar could be asymmetrical relative to its pivotal connection so that the latch bar by gravity returns to a predetermined position to hold the latch bar in the latch channels. In still another alternative, a hydraulic actuator could push the latch bar into a locked position. These are but examples of latching mechanisms and the latching mechanisms could be used individually or could be used in various combinations. Repositioning of the latch from the bottom of the door to the sides 90 results in less clogging, reduced maintenance needs as the latch is outside of the high wear area of the bucket, and a longer usable life for latch 86 as compared to latch 214.

Latches 214 and 86 are shown with doors 200 and 75 that are coupled to the bucket shell via conventional hinges 204 and 84. Latches 214 and 86 could be used with an inventive hinge 30 or 332 with a hinge axis 46 that is forward of back wall 12. In a construction with such a repositioned hinge axis 46, less force is needed to resist the opening of the door. As a result, the components of the latch can be smaller in size and have a smaller collective weight as compared to the conventional latches. The latch, or restraining mechanism, can also be moved away from the lower portion of the door because less total resistive moment is needed to retain the door in a closed position, as in latch 56, **56*a*, and 86. As noted above, a lower weight bucket enables the collection of a larger load in cavity 24** and/or the addition of more wear material.

Figure 10:
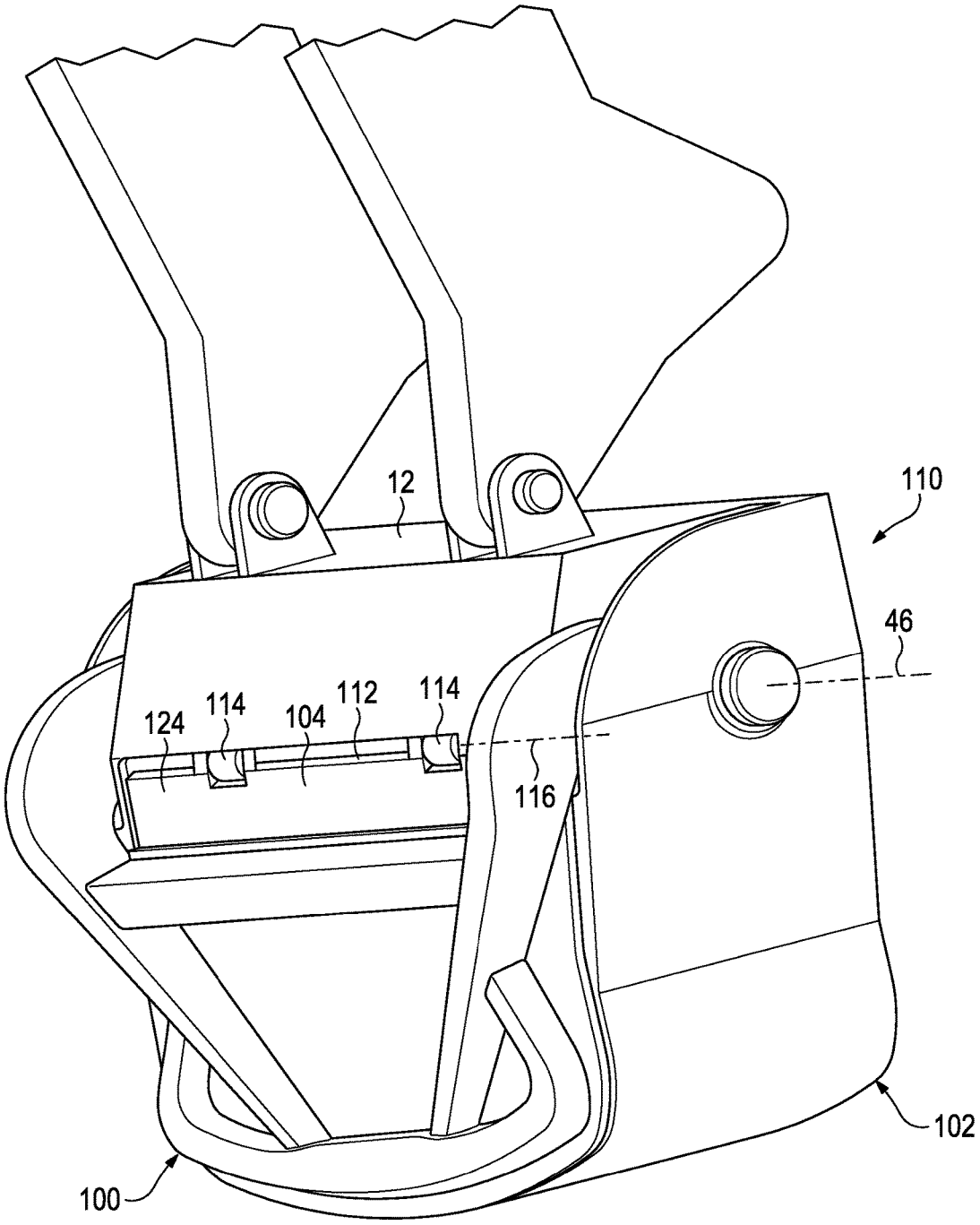
FIG. 10 is a perspective view of a fifth embodiment of a bucket in accordance with the present invention with only part of the stick shown.
Figure 11:
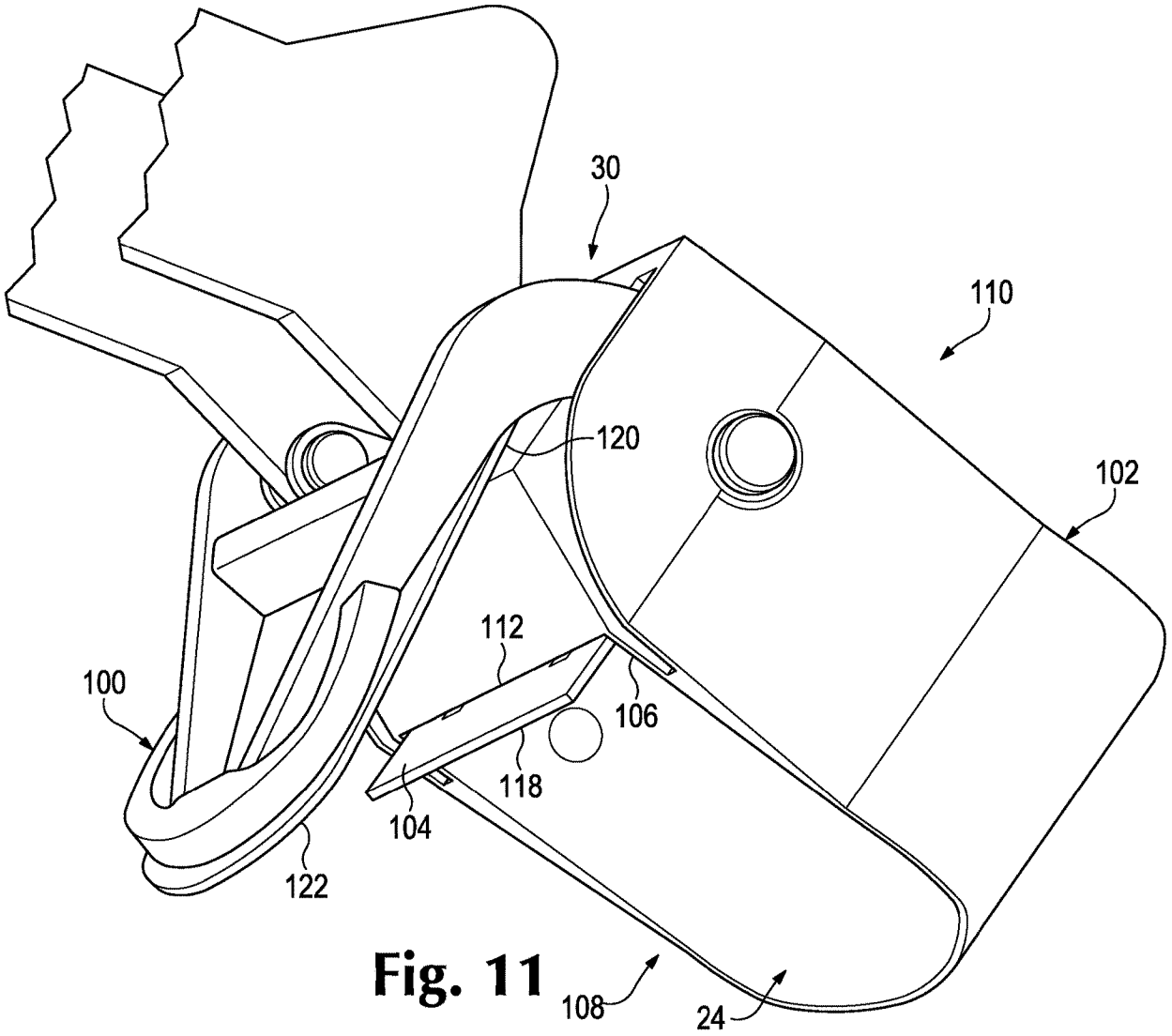
FIG. 11 is a perspective view of a fifth embodiment of the bucket in a dumping position.

In another aspect of the invention (FIGS. 10 and 11), a door 100 with hinge 30 can be retrofitted on an existing bucket (or on a new bucket with the same existing design). However, with some existing buckets, the door, if swung about a hinge axis 46 extending through cavity 24, would contact and interfere with the bucket shell 102 when swung to an open position if there were no further modification. To accommodate an interfering portion the door 100 is made shorter at its rear edge and a pivoting flap 104 is provided along the rear portion 106 of the bottom opening 108 of bucket 110. Flap 104 is coupled to shell 102 along its rear edge 112 by a pair of conventional hinges 114 so that flap 104 freely swings about a pivot axis 116. The front edge 118 of flap 104 sets along the rear end 120 of the inner surface 122 of door 100. When door 100 is in the closed position, flap 104 is also in the closed position because of its contact with inner surface 122 of door 100. The flap 104 prevents any of the load from being lost through the gap 124 existing between the rear end 120 of door 100 and shell 102. When door 100 is released for dumping the load, flap 104 swings on account of gravity with door 100 to avoid any obstruction of the material discharge. The door, because it is spaced forward from the back wall 12, clears the back wall during rotation about the repositioned hinge axis 46. The use of flap 104 is beneficial for certain bucket designs to permit the retrofitting of an inventive door 16 on an existing bucket. Flap 104 could also be used (in a new or existing bucket) to enable the use a smaller door for further reductions in bucket weight even if there were no interfering shell portion.

The various aspects of the invention can be used with each other or independently. As examples only, a door with a curved bottom end could be used with hinge members that place the hinge axis forward of back wall of the bucket, and a flap could be used with any of the bucket designs.

The invention claimed is:

1. A cable shovel bucket comprising a shell and a door collectively defining a cavity for gathering material during operation of the cable shovel, the shell including a front wall, an opposite back wall and sidewalls extending between the front wall and the back wall, the back wall having an exterior surface that faces the cable shovel when the bucket is in a dumping position, the door being pivotally secured to the shell for gravity activated movement between an open position and a closed position about a pivot axis extending through the cavity between the exterior surface of the back wall of the shell and the front wall and including a restraint to selectively hold the door in the closed position.

2. The cable shovel bucket in accordance with claim 1 wherein the door is pivotally secured to the shell by a pair of hinge members each connected to the door and pivotally secured to the shell.

3. The cable shovel bucket in accordance with claim 1 wherein the shell includes a front end and a rear end with supports to attach the bucket to the cable shovel, the front end having a digging edge to contact the ground in a digging operation and a heel, and wherein the door includes a front portion proximate the front end and a rear portion proximate the rear end, and the front portion of the door is bent forwardly toward the heel to abut a complementary shaped shell when the door is closed.

4. The cable shovel bucket in accordance with claim 3 wherein the front portion of the door is curved forwardly toward the heel.

5. A cable shovel bucket for use with excavating equipment comprising:

a back wall with an exterior surface and attachment supports rearwardly of the exterior surface for connecting the cable shovel bucket to the excavating equipment;

a front wall opposite the back wall;

a pair of opposing sidewalls each located between the back wall and the front wall; and a door adjacent the back wall, the front wall, and the sidewalls;

the back wall, the front wall, and the sidewalls collectively defining a shell; the shell and the door collectively defining a cavity to gather materials to be excavated; the door and the material within the cavity having a collective center of gravity; the door is secured to the shell with a pivot connection located between the exterior surface of the back wall and the collective center of gravity so that the door pivots about an axis in response to gravity between a closed position where the door is held against the front wall with a restraint for gathering the material to be excavated, and an open position where the restraint retracts and the door disengages from the front wall to dump the material to be excavated.

6. The cable shovel bucket according to claim 5 wherein the restraint is a releasable latch.

7. The cable shovel bucket according to claim 6 wherein the releasable latch secures the door to at least one of the sides of the bucket.

8. The cable shovel bucket according to claim 5 wherein a front end of the sidewalls and a front end of the door are curved forwardly toward the front wall and an opening of the cavity.

9. The cable shovel bucket according to claim 8 wherein the restraint is a releasable latch.

10. The cable shovel bucket according to claim 9 wherein the releasable latch secures the door to at least one of the sides of the bucket.

11. A cable shovel bucket comprising a shell including a front end having a digging edge and a rear end having supports to secure the bucket to the cable shovel, and a gravity actuated door pivotally secured to the shell for movement between an open position and a closed position, wherein the shell and the door when closed collectively define a cavity for gathering material during operation of the cable shovel, the gravity actuated door has a front portion proximate the front end of the shell and a rear portion proximate the rear end of the shell, and the front portion of the door is curved toward the digging edge to abut a complementary shaped shell when the door is closed and wherein the door pivots between the open position and the closed position about a pivot axis that extends forward of the exterior surface of the rear end of the shell spaced from the bucket supports and including a restraint to selectively hold the door in the closed position.

12. The cable shovel bucket in accordance with claim 11 wherein the restraint holds the door against the shell in the closed position and the restraint disengages the door from the shell in the open position.

13. The cable shovel bucket in accordance with claim 11 wherein the restraint is a releasable latch.

14. The cable shovel bucket in accordance with claim 11 wherein the front portion of the door is curved toward the digging edge.

* * * * *